United States Patent [19]

Pettengill

[11] Patent Number: 5,020,694

[45] Date of Patent: Jun. 4, 1991

[54] MULTI-CAVITY DISPENSING CONTAINER

[75] Inventor: Edwin R. Pettengill, Stratford, Conn.

[73] Assignee: Chesebrough-Pond's, Inc., Greenwich, Conn.

[21] Appl. No.: 324,588

[22] Filed: Mar. 16, 1989

[51] Int. Cl.[5] ..... B67D 5/52

[52] U.S. Cl. ..... 222/137; 222/566; 222/545; 222/386; 239/418

[58] Field of Search ..... 604/191, 220; 222/137, 222/136, 153, 386, 94, 571, 566, 132, 545; 239/432, 418, 306, 303; 215/6

[56] References Cited

U.S. PATENT DOCUMENTS

| | | | |
|---|---|---|---|
| 825,680 | 7/1906 | Raymond . | |
| 1,363,064 | 12/1920 | Stegath . | |
| 1,698,404 | 1/1929 | Hopkins . | |
| 1,699,532 | 1/1929 | Hopkins . | |
| 1,736,264 | 11/1929 | Johnson | 215/6 |
| 2,058,251 | 10/1936 | Nitardy et al. . | |
| 2,166,307 | 7/1939 | Libby . | |
| 2,661,871 | 12/1953 | Huenergardt . | |
| 2,752,920 | 7/1956 | Kurkjian | 604/220 |
| 2,789,731 | 4/1957 | Marraffino . | |
| 2,819,723 | 1/1958 | Meyer et al. . | |
| 2,918,199 | 12/1959 | Marraffino . | |
| 2,925,938 | 2/1960 | Parsons . | |
| 2,944,705 | 7/1960 | Strumor | 222/94 |
| 2,954,144 | 9/1960 | Elam et al. . | |
| 2,959,327 | 11/1960 | Bloom . | |
| 2,973,883 | 3/1961 | Modderno . | |
| 3,105,615 | 10/1963 | Koga . | |
| 3,166,221 | 1/1965 | Nielsen | 222/127 |
| 3,179,290 | 4/1965 | Whitney | 252/571 |
| 3,188,056 | 6/1965 | Trumball et al. . | |
| 3,197,071 | 7/1965 | Kuster . | |
| 3,200,995 | 8/1965 | Gangwisch . | |
| 3,217,931 | 11/1965 | Farrar et al. . | |
| 3,266,671 | 8/1966 | Gelpey . | |
| 3,326,416 | 6/1967 | Hayes . | |
| 3,335,912 | 8/1967 | Reeves Jr. . | |
| 3,442,424 | 5/1969 | Prussin et al. . | |
| 3,455,489 | 7/1969 | Meshberg . | |
| 3,458,076 | 7/1969 | Babcock . | |
| 3,486,661 | 12/1969 | Friedrich et al. . | |
| 3,490,651 | 1/1970 | Abplanalp . | |
| 3,499,387 | 3/1970 | Zippel | 222/137 |
| 3,503,539 | 3/1970 | O'Donnell . | |
| 3,508,682 | 4/1970 | Hollis et al. . | |
| 3,525,997 | 8/1970 | O'Donnell . | |
| 3,532,254 | 10/1970 | Burke . | |
| 3,540,623 | 11/1970 | Wittke et al. . | |
| 3,543,966 | 12/1970 | Ryan et al. . | |
| 3,570,719 | 3/1971 | Schiff . | |
| 3,591,054 | 7/1971 | Miles . | |
| 3,599,838 | 8/1971 | LaVange . | |
| 3,603,485 | 9/1971 | Vivier et al. . | |
| 3,613,956 | 10/1971 | McCulloch . | |
| 3,630,415 | 12/1971 | Murame et al. . | |
| 3,651,931 | 3/1972 | Hsiung . | |
| 3,672,544 | 6/1972 | Marand . | |
| 3,710,984 | 1/1973 | Webster . | |
| 3,731,848 | 5/1973 | Nakanishi . | |
| 3,735,900 | 5/1973 | Gores . | |
| 3,747,804 | 7/1973 | Raaf et al. . | |
| 3,767,078 | 10/1973 | Gortz et al. . | |
| 3,788,520 | 1/1974 | Dukess . | |

FOREIGN PATENT DOCUMENTS

| | | |
|---|---|---|
| 294672 | 12/1988 | European Pat. Off. . |
| 2095844 | 11/1972 | France . |

*Primary Examiner*—H. Grant Skaggs

*Attorney, Agent, or Firm*—Brumbaugh, Graves, Donohue & Raymond

[57] ABSTRACT

A rigid piston-type multi-cavity dispensing container for simultaneous coextrusion of two or more flowable materials in a predetermined proportion, such as multi-component toothpaste and the like which, upon relative compression of the upper and lower body members, produces a single, banded, unmixed stream of material. The container has a unique outlet which is arranged to cause the outlet streams of material to flow towards each other. The outlet maintains the segregation of the different materials as they move simultaneously outward through the outlet.

16 Claims, 6 Drawing Sheets

U.S. PATENT DOCUMENTS 3,799,398 3/1974 Morane et al. .
3,814,287 6/1974 Darbon et al. .
3,814,298 6/1974 Hansen ..... 222/153
3,850,346 11/1974 Richardson et al. .
3,870,147 3/1975 Orth .
3,876,111 4/1975 Swain .
3,885,710 5/1975 Cohen .
3,918,612 11/1975 Voulgaris .
3,931,912 1/1976 Hsiung .
3,964,643 6/1976 Morane et al. .
3,966,090 6/1976 Prussin et al. .
3,980,222 9/1976 Hood .
4,010,872 3/1977 Lozano et al. .
4,014,463 3/1977 Hermann .
4,040,420 8/1977 Speer .
4,046,288 9/1977 Bergman .
4,062,475 12/1977 Harris et al. .
4,062,477 12/1977 Morane .
4,073,406 2/1978 Goncalves .
4,089,437 5/1978 Chutter et al. .
4,098,435 7/1978 Weyn .
4,121,739 10/1978 DeVaney et al. ..... 222/137
4,159,066 1/1979 Silver .
4,240,566 12/1980 Bergman ..... 215/6
4,261,481 4/1981 Speer .
4,271,984 6/1981 Ducros et al. .
4,344,919 8/1982 Kelterbaum .
4,457,454 7/1984 Meshberg .
4,460,109 7/1984 Ducros et al. .
4,461,403 7/1984 Prahs .
4,463,875 8/1984 Tepic .
4,471,888 9/1984 Herb et al. .
4,487,757 12/1984 Klozpeoplou .
4,509,641 4/1985 Scieri et al. .
4,528,180 7/1985 Schaeffer .
4,566,610 1/1986 Herb .
4,582,224 4/1986 Proksa et al. .
4,585,149 4/1986 Zulauf .
4,742,940 5/1988 Wilkinson .
4,747,517 5/1988 Hart .
4,771,919 9/1988 Ernst ..... 222/94
4,813,871 3/1989 Friedman ..... 222/386

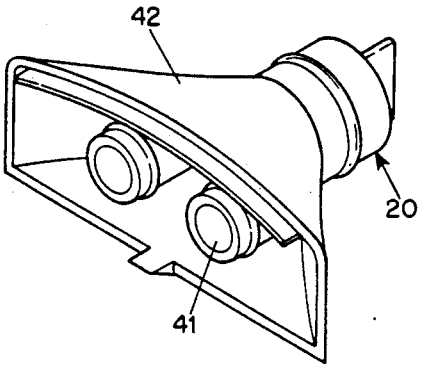
FIG. 5
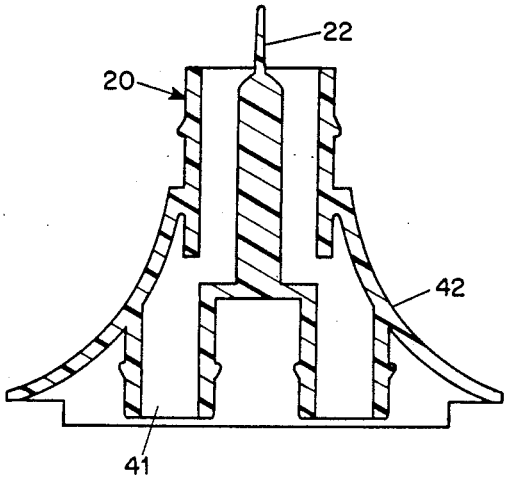
FIG. 6
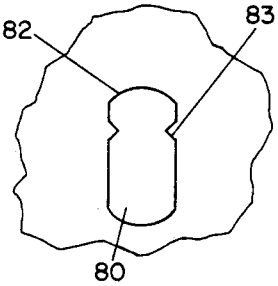
FIG. 8
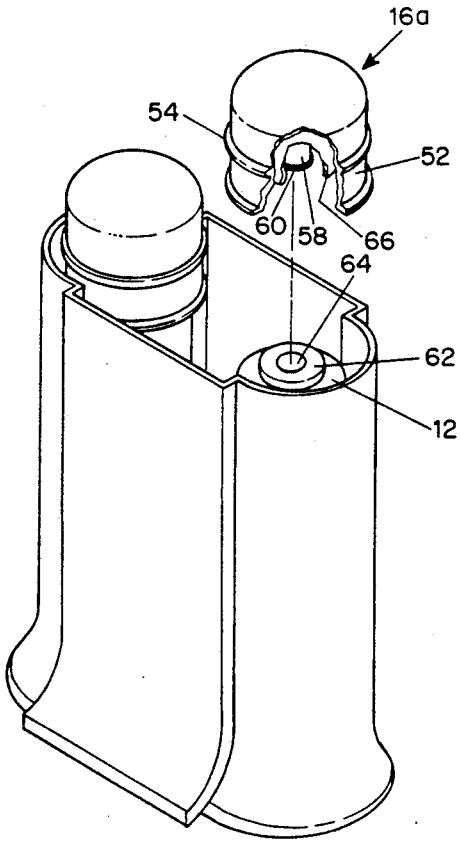
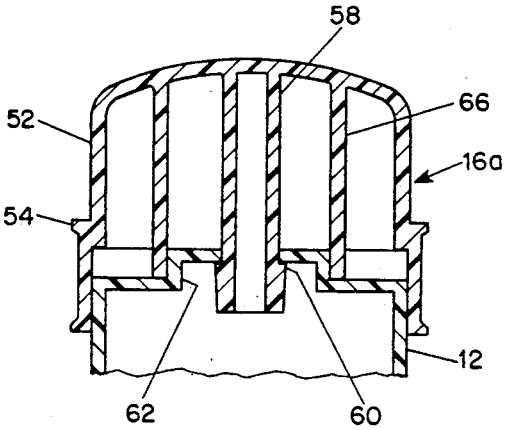
FIG. 10
FIG. 9

FIG. 7 A
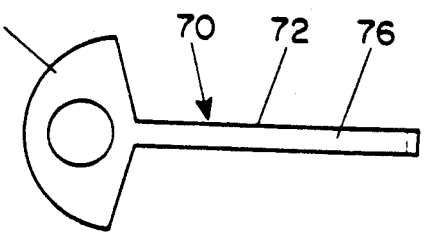
FIG. 7 B
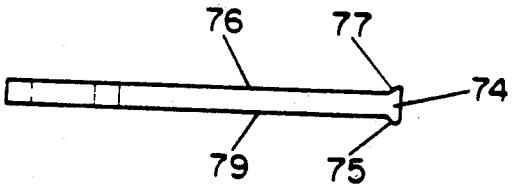
FIG. 7 C
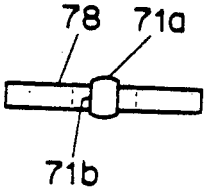
FIG. 7

MULTI-CAVITY DISPENSING CONTAINER

BACKGROUND OF THE INVENTION

1. Field of the Invention

The present invention relates to a rigid telescopically arranged multi-cavity dispensing container for a flowable material, such as toothpaste and the like, from which it is desired to dispense simultaneously two or more reactive substances which require separate storage until time of use.

2. Prior Art

There exists a desire to provide sodium bicarbonate and peroxide gel as components of toothpaste. Sodium bicarbonate is a well known and commonly used abrasive and cleaner. Peroxide gel is regarded as a beneficial ingredient to help promote healthy gums. These components are reactive when mixed, and therefore must be maintained separately until time of use.

U.S. Pat. No. 4,742,940 to Wilkinson discloses a basic single cavity dispenser. A hollow upper cylinder filled with a single flowable material has a dispensing spout but is otherwise closed at its upper end. A piston is arranged for telescopic upward movement within the upper cylinder so as to force a stream of flowable material through the spout upon relative compression of the piston and cylinder.

U.S. Pat. No. 4,747,517 to Hart discloses a single cavity container for simultaneously dispensing increments of two extrudable materials that polymerize when mixed. The two materials are separated by an extrudable barrier layer which prevents intermixing of the materials until after they emerge from the outlet. A piston slidably mounted within the cavity acts to force the materials through a specially-adapted mixing nozzle so that the materials emerge in an already-mixed state. The nozzle must then be removed and replaced after each use because of the trapped epoxy mixture which later hardens and clogs the passageway.

U.S. Pat. No. 3,166,221 to Nielsen discloses a rigid piston-type, double-tube dispensing container with a rigid barrier separating the two compartments. When the tube member is pushed down into the housing member, the contents will be pressed out through two separate nozzles. The contents emerge in the shape of two separate but closely juxtaposed bands which are difficult to dispense neatly onto the narrow width of a toothbrush.

U.S. Pat. No. 4,687,663 to Schaeffer discloses various configurations for simultaneously dispensing hydrogen peroxide and sodium bicarbonate. A rigid pump-type dual-cavity dispenser has two closely-positioned but separate outlets producing a double material stream which is difficult to apply to the narrow width of a toothbrush surface. Also disclosed is a collapsible tube separated into two compartments by a divider which extends to the rim of the mouth. Such an embodiment fails to take into account the possibility that the two components might have different rheologies, which will result in improperly proportioned quantities of the two materials being dispensed when the tube is squeezed.

U.S. Pat. No. 4,487,757 also discloses a toothpaste tube with separate compartments with a divider extending to the dispensing nozzle. Experimentation has shown that embodiments of this patent and the Schaffer patent tend to dispense the dual materials in an uncontrolled manner, for example, there is a tendency to dispense the dual material in uncontrolled varying proportions. Dispensing of the dual materials in predetermined proportions becomes even more difficult if the materials are of different rheologies. In addition, in certain embodiments there is a tendency of the materials to curl away from each other as they emerge from the nozzle, making it difficult to provide efficient dispensing onto a toothbrush.

It is thus an object of the present invention to provide a rigid piston-type multi-cavity dispensing container for simultaneous coextrusion in predetermined proportions of two or more flowable materials, which may have different rheologies, such as two components of a toothpaste and the like which, upon relative compression of the upper and lower body members, produces a single, banded, unmixed stream of material that can be neatly and easily applied onto the narrow width of a toothbrush.

It is a further object to provide such a dispenser which dispenses a single stream of unmixed material and which provides segregation of the component materials within the dispenser both prior to and after dispensing.

SUMMARY OF THE INVENTION

In accordance with the present invention there is provided a multi-cavity dispensing container for the simultaneous coextrusion of at least two flowable materials. The container includes at least two hollow and separate parallel cylinders having a first generally closed end and a second end which telescopically and slidingly accommodates a corresponding number of parallel pistons which conform to ride sealingly along the interior walls of the cylinders to force the flowable materials toward the first end of the cylinders upon relative compression of the cylinders and pistons. The cylinders are provided with outlet channels communicating with an outlet means having adjacent outlet openings and means for causing the flowable materials to flow towards each other at the outlet openings to form a single, banded, unmixed stream of the materials.

In a preferred arrangement the outlet means includes a tapered septum dividing the outlet means. A hinged cap having conforming recesses for receiving the outlet end of the outlet means and the septum may be provided. The cylinders and pistons may be provided with conforming shrouds for guiding relative motion of the cylinders and pistons.

For a better understanding of the present invention together with other and further objects, reference is made to the following description, taken in conjunction with the accompanying drawings, and its scope will be pointed out in the appended claims.

BRIEF DESCRIPTION OF THE DRAWINGS

FIG. 5 is a projection view of the nozzle housing of the embodiment of FIG. 2.

FIG. 6 is a lengthwise cross-sectional view of the FIG. 5 nozzle housing.

FIGS. 7A, 7B, and 7C are the top, side and frontal views, respectively, of the key used with the FIG. 2 embodiment.

FIG. 8 is a frontal view of the locking mechanism portion of the embodiment of FIG. 2.

FIG. 9 is a projection view of the base portion of the FIG. 2 embodiment showing the piston head.

FIG. 10 is a vertical cross-sectional view of the FIG. 9 piston head.

DETAILED DESCRIPTION

Figure 1:
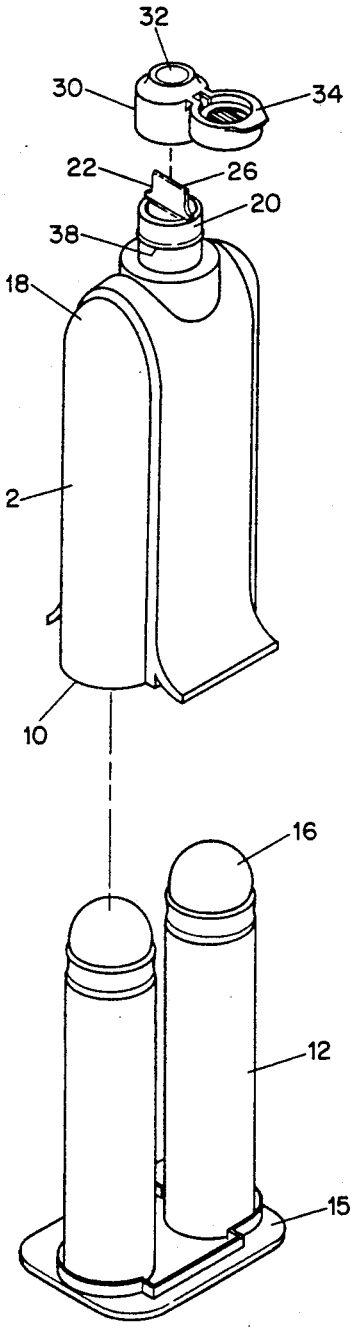
FIG. 1 is an exploded projection view of a syringe-type dual-cavity embodiment of the invention.
Figure 3:
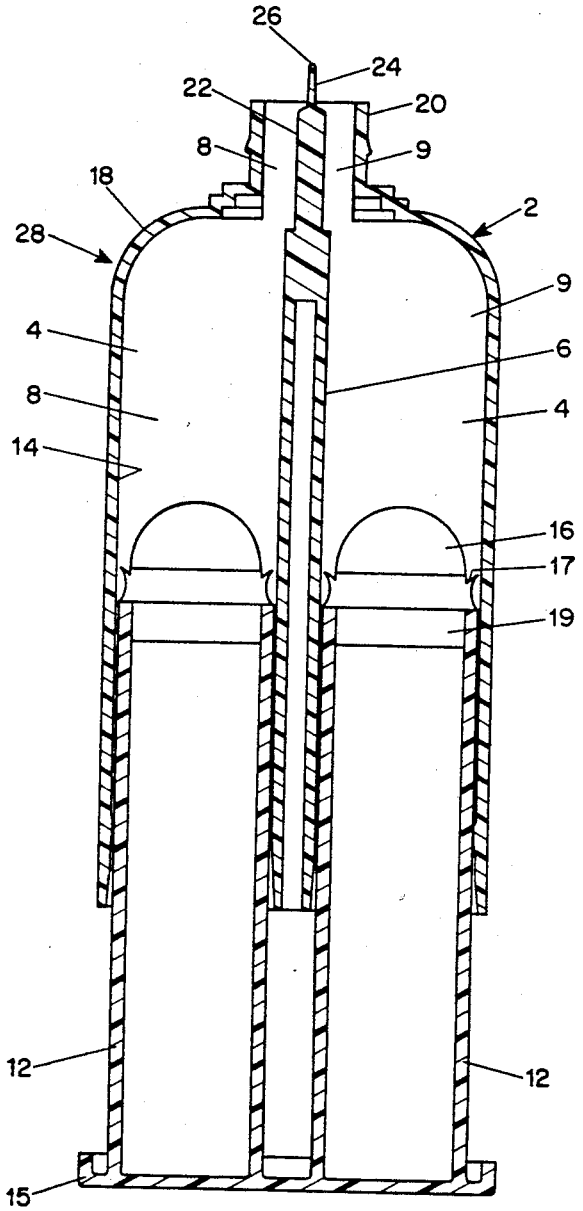
FIG. 3 is a frontal cross-sectional view of the embodiment of FIG. 1.
Figure 4:
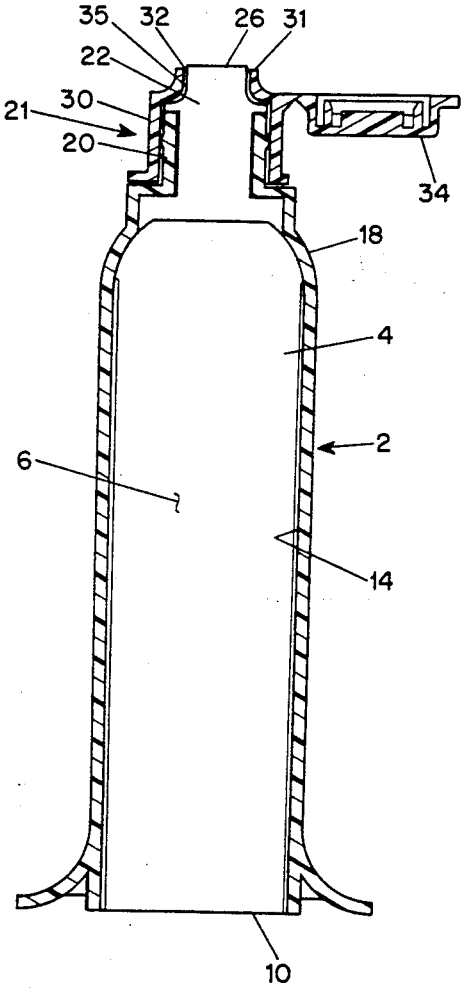
FIG. 4 is a side cross-sectional view of the sleeve portion of the embodiment of FIG. 1.

One embodiment of a device according to the invention will first be described as a "syringe version" for dispensing two materials, with reference to FIGS. 1, 3 and 4. A rigid sleeve 2 has two parallel hollow cylinders 4 separated by a rigid barrier 6. The two cylinders 4 each contain one of two reactive flowable materials 8, 9. The sleeve 2 is open at its bottom 10 to telescopically and slidingly accommodate a pair of parallel pistons 12 which conform to ride sealingly within the inner walls 14 of the cylinders 4. The pistons 12 are fixed to a multi-function base 15 which provides leverage for hand dispensing and which permits the device to stand upright when not in use. Furthermore, the base rigidly retains the pistons so as to provide for the smooth, equal and simultaneous movement of the two pistons into the cylinders during operation. The piston heads 16 should substantially conform to the shape of the upper closed portion 18 of the sleeve 2 so as to efficiently dispense the entire contents 8, 9 of the package. To accomplish this, the heads 16 may be of a hemispherical or other rounded shape. In the embodiment illustrated, the piston heads 16 are fabricated of a pliable material and include sealing rings 17 which press against the cylinder walls to provide a seal. A lower cylindrical extension 19 of the piston head 16 is received into the hollow end of each piston 12 and has a locking lip to retain it fixedly therein.

The closed upper end 18 of the sleeve 2 has a cylindrical dispensing outlet passage 20 located diametrically above the barrier 6. The outlet passage 20 has two passageways, each of which connects to one of the two hollow cylinders 4 containing the materials 8, 9. Upon relative compression of the sleeve 2 and piston portion 12, the materials 8, 9 will flow into the respective passageways of outlet passage 20. The outlet passage 20 is arranged to receive a separate nozzle 30, which together comprise the outlet means 21.

The outlet passage 20 is bisected by a flat rigid septum 22 extending from the barrier 6 and sitting fixedly within the inner walls of the outlet passage 20. The septum 22 is tapered 24 cross-sectionally and ends in a straight edge 26. The cross-section of the septum edge 26 is a sharp angle approximated by a very small radius. The sides of the septum are preferably textured, for example by vapor honing, to a dull finish to promote adherence of the products thereto, which together with the taper 24 causes the product streams to converge into a single stream at the outlet opening 32 of nozzle 30.

The septum 22 of this unique nozzle design acts to keep the two reactive materials 8, 9 separate as they emerge from the cylinders 4 and also prevents reaction and obstruction of the outlet means 21 by reaction products. The materials 8, 9 converge as they flow through the outlet means 21 but the two streams do not meet until they have fully left the outlet means opening 32. The taper design of the septum 22 causes the two streams 8, 9 to gradually converge until they meet at the septum edge 26 beyond the end of the outlet means opening 32. At this point, they smoothly touch and continue to flow onto the intended surface, e.g. toothbrush, as a single, substantially cylindrical, two-banded stream. This single stream is convenient and easy to direct with accuracy upon a limited surface area.

The diameter of the emerging single stream may be regulated according to packaging specifications. For example, nozzle 30 which snaps on around the outlet passage 20 by engaging ridge 38 may be provided. Nozzle 30 has an interior taper which reduces the effective outlet passage diameter as shown in FIG. 4. In such an embodiment, the length of the septum edge 26 is reduced and the side edges of the septum conform to the converging inner shape 35 of the nozzle 30.

Figure 13:
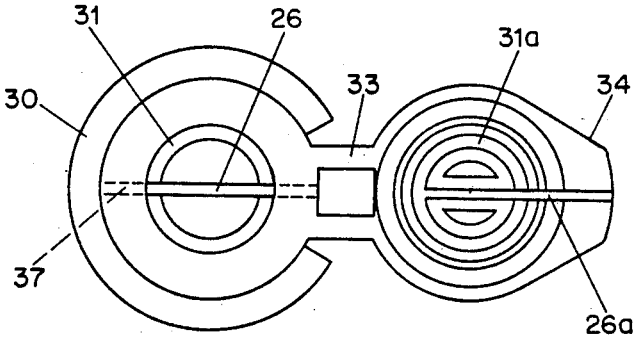
FIG. 13 is a top view of a cap and nozzle arrangement for a dual-cavity embodiment of the invention.
Figure 14:
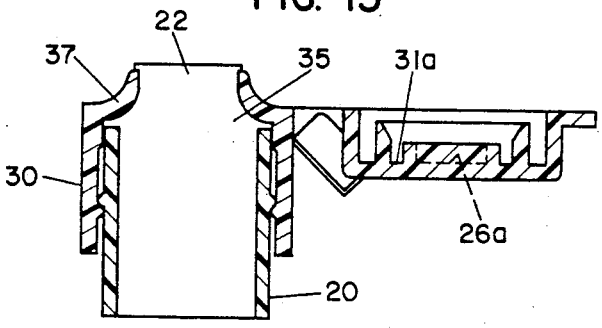
FIG. 14 is a side cross-sectional view of the nozzle arrangement of FIG. 13.

With reference to FIGS. 13 and 14, nozzle 30 is provided with longitudinal grooves 37 along its converging inner wall for retaining the inward sloping sides of the septum 22 residing therein. Such an arrangement maintains the septum 22 in a rigid position within the outlet means 21 and prevents intermixing of the streams at contact points of the assembled septum 22 and outlet means 21. The septum 22 extends to a location preferably 0.005 to 0.010 inches beyond the outlet means opening 32.

The nozzle 30 preferably has a cap 34 connected thereto by a hinge 33. Cap 34 includes a complementary engaging means comprising recesses 31*a* and 26*a* for receiving respectively nozzle rim 31 and septum edge 26 during closure, so that intermixing of the two substances 8, 9 is prevented once the cap is closed.

As an important aspect of the present invention, the outlet means 21 is provided with one or more means for causing the outlet streams to flow toward each other and avoid the otherwise uncontrolled outlet flow which can result in the streams of the two or more materials flowing away from each other as they emerge from the outlet opening. The means may include a tapered septum 22 which divides the outlet, tapered peripheral walls on the outlet means as exemplified by nozzle 30, shown in FIGS. 4 and 14, or a differential surface resistance on the interior walls of the outlet means, such that greater surface resistance is provided on the interior surfaces which are adjacent to other outlet openings than on the peripheral interior surfaces of the outlet means. Thus, in the embodiment of FIG. 4, the surfaces of septum 22 may be provided with a dull finish, such as by vapor honing, while the interior peripheral surfaces of nozzle 30 remain smooth. As the materials flow over the surfaces there will be greater resistance to the flow over the septum causing the flow of materials to "curl"

in the direction of the septum as they emerge from the outlet, whereby the two or more streams of materials curl towards each other and converge into a single stream. Alternately, the interior peripheral surfaces of the outlet means can be treated, e.g. with a lubricant, such as polytetrafluoroethylene or silicone materials to reduce the surface friction of the interior peripheral surfaces as compared to the surface friction of the septum 22.

Figure 2:
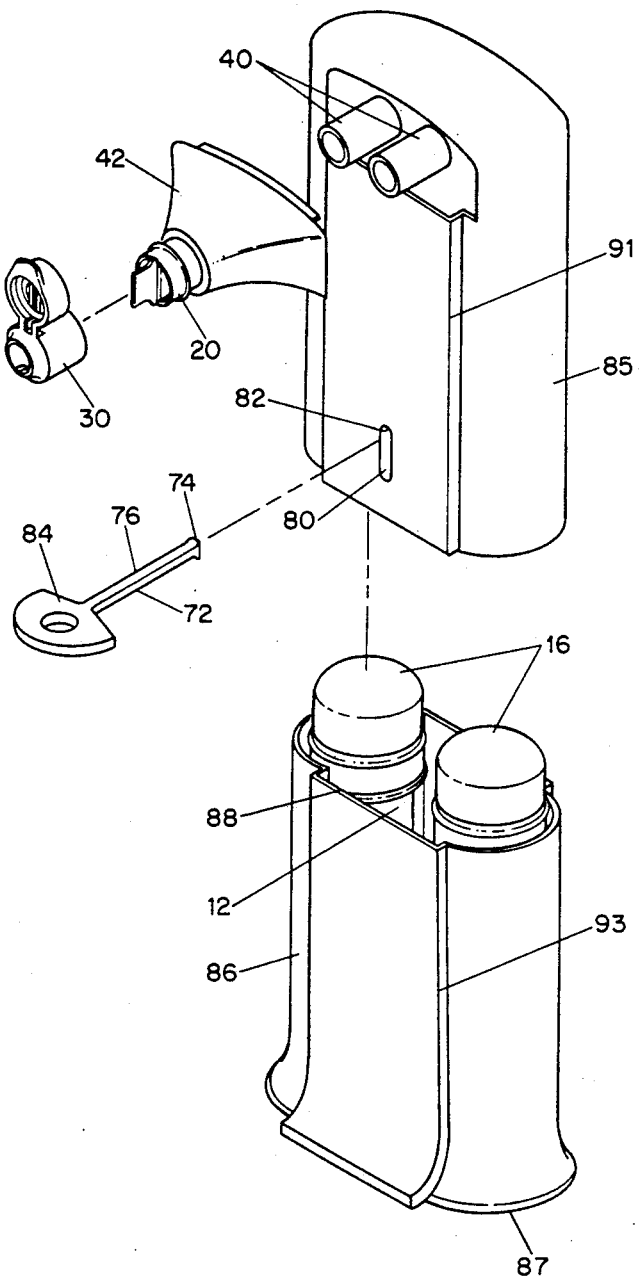
FIG. 2 is an exploded projection view of a pump-type dual-cavity embodiment of the invention.

Another embodiment of the device, the pump version, shown in FIG. 2 in a dual-cavity arrangement, includes upper shroud 85 and lower shroud 86 telescopically engagable for relative compression by a single force exerted down on the top against the ground surface supporting an anti-rocking base 87. Upper shroud 85 includes two cylinders, similar to those of the FIGS. 1 and 3 embodiment, except that the outlet passages connected to the closed upper end of the cylinders are brought out sideways to connect to tubes 40. Upper shroud 85 includes a longitudinal projecting ridge 91. Lower shroud 86 surrounds a pair of cylinders 12 having cylinder heads 16. Cylinders 12 are connected to shroud 86 by base 87, which is enlarged to provide greater stability for the assembly. Shroud 86 is provided with a ridge 93 and is dimensioned to receive upper shroud 85 so that shroud 85 is received between pistons 12 and shroud 86 when pistons 12 are inserted within the cylinders of upper shroud 85. As the two portions are assembled, ridges 91 and 93 serve to guide the motion of the two portions, providing smooth linear motion even where the materials in the two cylinders have a different rheologies.

This "pump version" also has an outlet assembly 42, shown in FIGS. 5 and 6, which provides for a forward facing dispensing nozzle. Two hollow cylinders within upper sleeve 85 have outlet passages that extend into two separate forward facing tubes 40 of reduced diameter. An outlet assembly 42 is fitted about the tubes 40 and converges so as to end in an outlet passage 20 with two passageways as described above. The tubes 40 receive tube sleeves 41 of the outlet assembly 42. As the tube sleeves 41 converge within the outlet assembly 42, they form a common rigid barrier which extends through the outlet means 21 as a septum 22, described above. A nozzle 30 may also be provided as described above to additionally comprise the outlet means 21.

The shrouds 85, 86 of the pump version may possess guide means 91, 93 on either of two opposing sides comprising conforming, longitudinal, outward, rectangular extensions of the shrouds 85, 86 having parallel side walls and flat facing surfaces, one of which guide means 91 rides within a longitudinal interior groove formed by the other guide means 93 during relative compression of the sleeves. The guide means prevent rocking of one sleeve within another and consequent uneven relative motion of the two pistons. Therefore, materials 8, 9 of differing rheologies may be dispensed in a predetermined proportions. It is understood that the guide means may be of any acceptable shape and comprise a plurality of extensions, both inward and outward. In addition to providing guided relative motion of the shrouds, the extensions improve the mechanical rigidity of the shrouds.

Further embodiments of both the syringe and pump versions of the device may employ a reversed piston orientation wherein the upper member includes the pistons and the outlet passages, and the lower member includes the cylinders containing the flowable materials. As relative compression of the upper and lower portions takes place, the materials are forced upward through separate paths formed within the upper member leading to the outlet means.

Figure 12A:
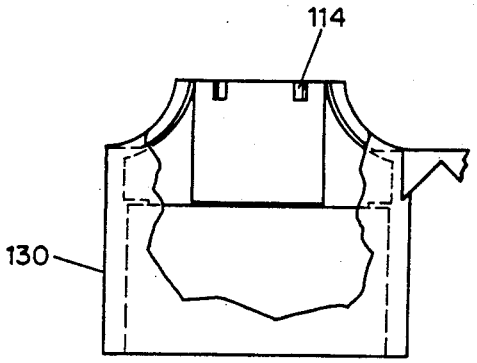
FIG. 12A is a partial cutaway frontal view of a striping nozzle.
Figure 12B:
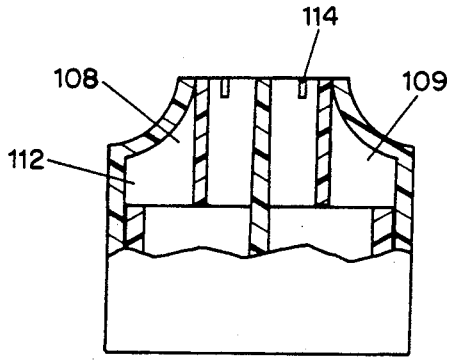
FIG. 12B is a side cross-sectional view of the striping nozzle of FIG. 12A.
Figure 11:
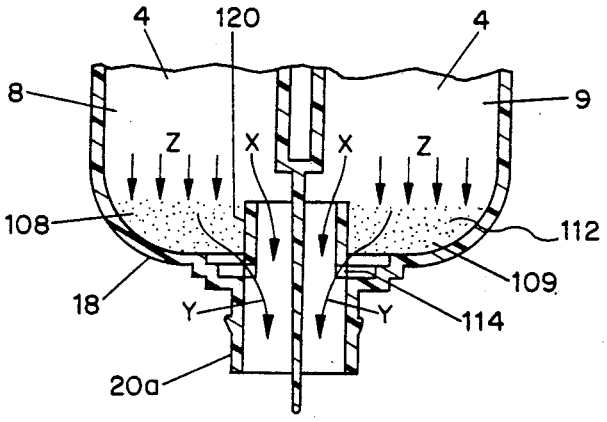
FIG. 11 is a cross-sectional view of a striping mechanism useful with the embodiment of FIG. 1.

Additional embodiments of both versions may also possess a striping feature, whereby, e.g., color or flavor additives, or functional ingredients are imparted to at least one stream as it passes through the outlet means 21. For the syringe version, as shown in FIG. 11, an amount of striping fluid 108, 109 is contained near the upper closed portion 18 of each cylinder 4. A striping fluid retaining region 112 is defined by the upper closed portion 18 of each cylinder 4 and by an extension 120 into each cylinder 4 of the outlet passage 20. As the contents 8, 9 are forced towards the upper closed portion 18 during use, they will pass through the outlet passage 20, as indicated by the arrows "X". The contents 8, 9 will at the same time apply force against the striping fluids 108, 109 as indicated by the arrows "Z". Under this force, the striping fluids 108, 109 will be forced as shown by arrows "Y" through one or more relatively small orifices 114 interconnecting the retaining region 112 and the outlet passage 20*a*. Thus, upon compression of the device, amounts of striping fluid 108, 109 will enter the respective outflowing streams 8, 9. Additionally, the striping feature may be imparted by a striping nozzle, shown in FIGS. 12A and 12B. The striping nozzle 130 is fitted about the outlet passage 20 in similar fashion to the nozzle 30 described above, and operates as does the above-described striping feature. Striping fluids 108, 109 are located in retaining regions 112 within the striping nozzle 130. Amounts of the fluids 108, 109 are picked up by and carried along with the outgoing streams 8, 9 via contact at one or more communicative orifices 114.

Figure 15:
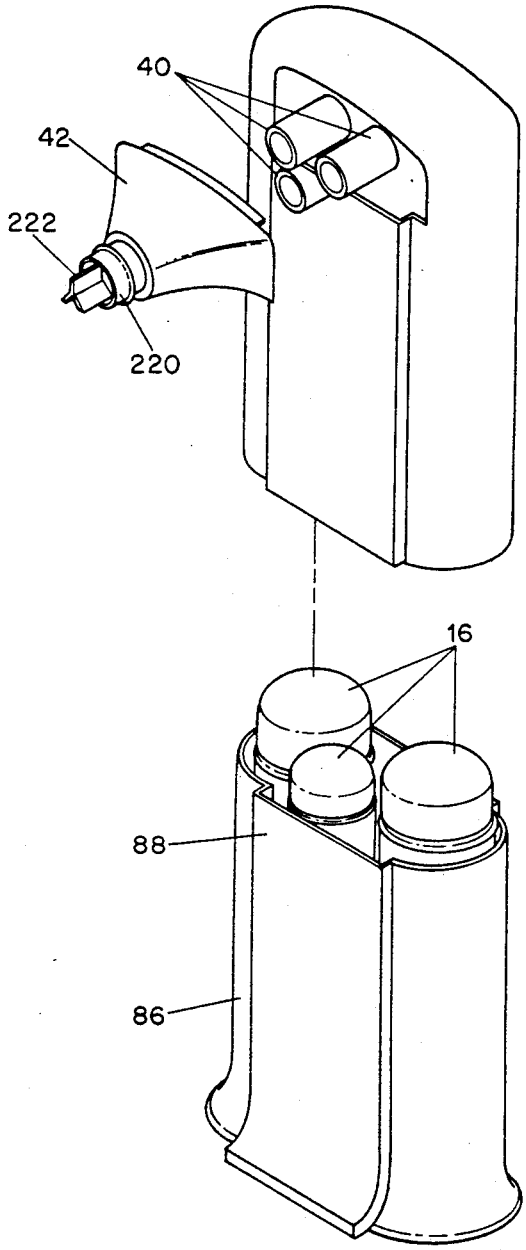
FIG. 15 is an exploded projection view of a pump-type three-cavity embodiment of the invention.

It is easily seen that the device may also be extended to simultaneously dispense more than two materials by providing an increased number of parallel hollow cylinders and corresponding number of pistons. The nozzle may be appropriately subdivided by a septum assembly having septum members extending to the nozzle walls from a central point. FIG. 15 shows a three-cavity dispenser. The outlet passage 220 is divided by the septum assembly 222 which includes three planar septum members dividing the outlet into three separate passages. The above descriptions relating to a recessed cap 34 and recesses on the inner walls of the nozzle 30 may be easily adapted to a tripartite or multipartite septum assembly.

The dispenser may further possess an improved piston head, shown in FIGS. 9 and 10, which is characterized by its simplicity and ease of assembly. The piston head 16*a* has an exterior shell 52 of a flexible material such as soft plastic or the like. The shell has a circumferential wiping surface 54 for bearing against the inner walls 14 of the cylinders 4. A cylindrical plug 58 is mounted within the shell 52, the plug 58 having an enlarged rib 60 which enters bore 64 formed on the end 62 of the piston 12. The cylindrical plug 58 supports the piston head 16a against removal from piston 12. An intermediate cylindrical member 66 surrounds projecting piston end 62 and supports piston head 16*a* against the piston end 62. The intermediate cylindrical member 66 acts to push the shell 52 along with the piston 12 when the piston is pushed into the cylinder 4 during operation of the dispenser.

An embodiment of the pump version of the device may additionally contain a locking mechanism, shown in FIGS. 7 and 8, which prevents unwanted relative compression of the upper cylinder portion and lower piston portion during shipping and at other times before first use is desired. A key 70, shown in FIGS. 7A, 7B and 7C comprises a rod 72 of rectangular cross-section. The rod may be straight, as shown in FIG. 2, or may at its end 74 have at least one of opposing sides 76, 79 sloping upward 77, 75 to form an enlarged end 78 of partial circular cross-section as shown in FIG. 7. As shown in FIG. 2, before assembly of the device, the key 70 is inserted through at least one longitudinal slot 80, preferably two slots formed in the front and back faces of the upper sleeve 85. When the key has sloping opposing sides, the key 84 is then rotated so that the round sides 71*a* of the end face 78, which are wider apart than the width of the slots 80, prevent it from being pulled outward from the upper sleeve 85. When a straight rod is used, it is dimensioned to snugly fit into slot 80 and be held therein by friction.

When the device is assembled, the upper sleeve 85 is telescopically placed into the rigid lower sleeve 86 which fixedly houses the pistons 12 therein. The rod 72 abuts the upper end 88 of the lower sleeve 86, and is retained above by a stop 82 formed by the end of the slots 80. Slot 80 may include side edge ridges 83 to retain the rod near the stop 82. Thus, further relative movement of the sleeves 85 and 86 is prevented. If the key has sloping opposing sides when first use is desired, the key may be rotated so that the straight sides 71*b* of the end face 78 line up with the edges of the slot. The key 84 is then pulled outward and compression of the device is permitted. Using greater force the key may be removed without rotation. When a straight rod is used the key maybe removed without rotation by simply pulling straight out.

Figure 16:
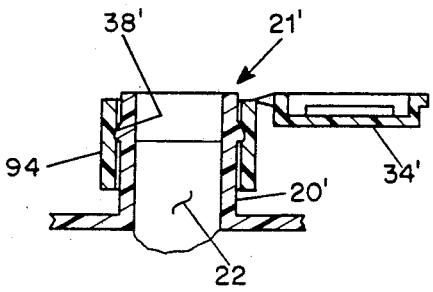
FIG. 16 is a cross-sectional view of an alternate embodiment of the outlet means for a dispenser of the present invention.
Figure 17:
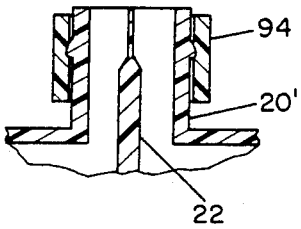
FIG. 17 is a perpendicular cross-section of the FIG. 16 outlet means.

FIGS. 16 and 17 are cross-sectional views showing an alternate outlet arrangement. In the outlet means 21', septum 22 is molded to outlet passage 20' which extends to the septum edge 26. A sleeve 94 surrounds outlet 20' and provides a mounting piece for flip cap 34'. Ridge 38' circumferentially surround outlet passage 20' and retain sleeve 94 in position by a matching circumferential groove. Cap 34' contains the conforming recesses for engaging the outlet openings formed by outlet passage 20' and septum edge 26.

While there have been described what are believed to be the preferred embodiment of the present invention, those skilled in the art will recognize that other changes and modifications may be made thereto without departing from the spirit of the invention and it is intended to claim all such changes and modifications as fall within the true scope of the invention.

I claim:

1. A multi-cavity dispensing continer for the coextrusion of at least two flowable materials, comprising:

a dispensing container comprising at least two hollow and separate parallel cylinders, each cylinder for containing one of said flowable materials, said cylinders having a first generally closed end and a second end telescopically and slidingly accommodating at least two parallel pistons which conform to ride sealingly along the interior walls of said cylinders so as to force said flowable materials to flow toward said first end of said cylinder upon relative compression of the cylinders and pistons, said cylinders having outlet channels; and an outlet means in fluid communication with said outlet channels, said outlet means having a peripheral wall and being divided by at least one flat tapered septum assembly extending from said outlet channels and extending to or beyond the end of said outlet means to completely separate said flowable materials within said outlet means while being dispensed and to cause said materials to be dispensed in a single unmixed stream; said outlet means includes smooth peripheral walls and wherein said tapered septum is textured so as to possess a dull finish.

2. The dispensing container of claim 1 wherein the cross section of the septum edge approaches a sharp angle of very small radius.

3. The dispensing container of claim 1 wherein said tapered septum extends 0.005 to 0.010 inches beyond the end of said outlet means.

4. The dispensing container in any of claims 1, 2 or 3, wherein said outlet means comprises an outlet passage in fluid communication with said outlet channels and including said septum and a nozzle member, said nozzle member having interior longitudinal grooves for receiving the side edges of said septum so as to retain the septum in a rigid state and to prevent cross-mixing of the materials within the outlet means.

5. The dispensing container of claim 4, wherein said outlet means has attached thereto a hinged cap member, wherein said cap member has conforming recesses for receiving the outlet end of said nozzle and said septum edge upon closure of the cap member, whereby cross-mixing of the materials is prevented.

6. The dispensing container of claim 1, further comprising:

a first shroud surrounding said cylinder;

and a second shroud connected to and surrounding said pistons, said first shroud being arranged to closely conform in sliding relation within said second shroud, whereby relative motion between said shrouds is constrained to be substantially linear proving equal linear motions of said pistons into said cylinders.

7. The dispensing container of claim 6, wherein each of said first and second shrouds have conforming longitudinal guide members for guiding said linear motion.

8. The dispensing container of claim 7, wherein said guide members comprise an outwardly extending longitudinal ridge on said first shroud and an interior longitudinal groove on said second shroud for receiving said ridge.

9. A dispensing container as specified in claim 1, wherein said cylinders are arranged in a first member and said pistons are arranged on a second member, further comprising a locking means for preventing relative compression of said first and second members, comprising:

a rod and first and second longitudinal slots arranged on opposite sides on one of said members for receiving and retaining said rod, said rod being retainable in and removable from said slot, and said rod, when inserted, preventing compression of said first and second members.

10. A multi-cavity dispensing container for the coextrusion of at least two flowable materials, comprising:

a dispensing container comprising at least two hollow and separate parallel cylinders, each cylinder for containing one of said flowable materials, said cylinders having a first generally closed end and a second end telescopically and slidingly accommodating at least two parallel pistons which conform to ride sealingly along the interior walls of said cylinders so as to force said flowable materials to flow toward said first end of said cylinder upon relative compression of the cylinders and pistons, said cylinders having outlet channels;

an outlet means in fluid communication with said outlet channels, said outlet means having a peripheral wall and being divided by at least one flat tapered septum assembly extending from said outlet means to completely separate said flowable materials within said outlet means while being dispensed and to cause said materials to be dispensed in a single unmixed stream; and a cap member for covering said outlet, said cap member including recesses conforming closely to the cross-sectional boundaries of said outlet passages formed by said peripheral wall and said septum whereby cross-mixing of said materials is prevented when said outlet is covered by said cap member.

11. In a dispensing container having multiple cylinders and multiple pistons for being received in said cylinders, the improvement comprising:

a first shroud incorporating said cylinders;

and a second shroud connected to and surrounding said pistons, said first shroud being arranged to closely conform in sliding relation within said second shroud and surrounding said pistons whereby relative motion between said shrouds is constrained to be substantially linear by said shrouds, thereby providing equal linear motions of said pistons into said cylinders; wherein each of said first and second shrouds have conforming longitudinal guide members for guiding said linear motion comprising an outwardly extending rectangular longitudinal rdige on said first shroud having a flat outwardly facing surface and parallel side walls and an interior rectangular longitudinal groove on said second shroud having a flat inwardly facing surface and parallel side walls for receiving said ridge.

12. A multi-cavity dispensing container for the coextrusion of at least two flowable materials, comprising:

a dispensing container comprising at least two hollow and separate parallel cylinders, each cylinder for containing one of said flowable materials, said cylinders having a first generally closed end and a second end telescopically and slidingly accommodating at least two parallel pistons which conform to ride sealingly along the interior walls of said cylinders so as to force said flowable materials to flow toward said first end of said cylinder upon relative compression of the cylinders and pistons, said cylinders having outlet channels; and an outlet means in fluid communication with said outlet channels, said outlet means including adjacent outlet openings unconnected to each other and having means for causing said flowable materials to flow toward each other at said outlet openings to form a single, banded, unmixed stream of said materials outside of said outlet wherein said means for causing said flowable materials to flow toward each other comprises providing said outlet means with surfaces having treater resistance to material flow near said outlet openings on interior surfaces of said outlet means which are adjacent other outlet openings than on peripheral interior surfaces of said outlet means.

13. A multi-cavity dispensing container as specified in claim 12 wherein said greater resistance is provided by texturing said adjacent interior surfaces.

14. A multi-cavity dispensing container as specified in cliam 12 wherein said greater resistance is provided by providing friction reducing coating on said peripheral interior surfaces.

15. A multi-cavity dispensing container as specified in claim 12 wherein said means for causing said flowable materials to flow toward each other further comprises tapers insaid outlet means.

16. A multi-cavity dispensing container as specified in claim 12 wherein there are provided three or more of said cylinders, said pistons and said outlet channels.

* * * * *